US009074498B2

(12) United States Patent
Strauss

(10) Patent No.: US 9,074,498 B2
(45) Date of Patent: Jul. 7, 2015

(54) CAMSHAFT PHASER

(75) Inventor: Andreas Strauss, Forchheim (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 14/007,855

(22) PCT Filed: Feb. 23, 2012

(86) PCT No.: PCT/EP2012/053097

§ 371 (c)(1),
(2), (4) Date: Sep. 26, 2013

(87) PCT Pub. No.: WO2012/136409

PCT Pub. Date: Oct. 11, 2012

(65) Prior Publication Data

US 2014/0020643 A1 Jan. 23, 2014

(30) Foreign Application Priority Data

Apr. 4, 2011 (DE) ..... 10 2011 006 689

(51) Int. Cl.

| | |
|---|---|
| ***F01L 1/34*** | (2006.01) |
| ***F01L 1/344*** | (2006.01) |
| *F15B 15/12* | (2006.01) |

(52) U.S. Cl.

CPC ..... *F01L 1/3442* (2013.01); *F01L 2001/34493* (2013.01); *F15B 15/12* (2013.01)

(58) Field of Classification Search

CPC ..... F01L 1/3442; F01L 2001/34486; F01L 2001/34493; F01L 2001/34483

See application file for complete search history.

(56) References Cited

U.S. PATENT DOCUMENTS

| | | | | |
|---|---|---|---|---|
| 2,911,956 | A | 11/1959 | Smith, Jr. | |
| 2003/0177991 | A1 | 9/2003 | Palesch et al. | |
| 2005/0226736 | A1 | 10/2005 | Lancefield et al. | |
| 2009/0173297 | A1 | 7/2009 | Hutcheson et al. | |
| 2009/0255497 | A1 * | 10/2009 | Davis | 123/90.17 |
| 2010/0093453 | A1 | 4/2010 | Myers et al. | |
| 2011/0023805 | A1 * | 2/2011 | Takemura | 123/90.17 |

FOREIGN PATENT DOCUMENTS

| | | |
|---|---|---|
| DE | 10 2009 041 755 | 4/2010 |
| EP | 1 347 154 | 9/2003 |
| GB | 2 369 175 | 5/2002 |
| GB | 2 432 645 | 5/2007 |
| GB | 2 444 943 | 6/2008 |
| WO | WO 01/12996 | 2/2001 |

* cited by examiner

*Primary Examiner* — Thomas Denion
*Assistant Examiner* — Daniel Bernstein
(74) *Attorney, Agent, or Firm* — Davidson, Davidson & Kappel, LLC

(57) ABSTRACT

An arrangement of a camshaft phaser (1) which has a drive element (2) and at least two driven elements (3, 4), whereby the drive element (2) and the driven elements (3, 4) have several radially oriented vanes (6) that cover the lateral surfaces (9) of the adjacent element in the axial direction (7).

13 Claims, 2 Drawing Sheets

CAMSHAFT PHASER

The invention relates to a camshaft phaser.

BACKGROUND

Camshaft phasers are used in internal combustion engines in order to vary the timing of the combustion chamber valves. Adapting the timing to the current load lowers fuel consumption and reduces emissions. A commonly employed model is the vane-type adjuster. Vane-type adjusters have a stator, a rotor and a driving gear. The rotor is usually non-rotatably joined to the camshaft. The stator and the driving gear are likewise joined to each other, whereby the rotor is situated coaxially to the stator as well as inside the stator. The rotor and the stator have radial vanes that form oil chambers which counteract each other, which can be filled with oil under pressure and which allow a relative movement between the stator and the rotor. Moreover, the vane-type adjusters have various sealing lids. The assembly comprising the stator, driving gear and sealing lid is secured by means of several screwed connections.

U.S. Pat. Appln. No. 2009/0173297 A1 discloses a hydraulic camshaft phasing device that has a driving gear and, coaxially thereto, a stator with two rotors arranged concentrically to the stator. Here, the stator can be configured so as to consist of a single part or else of several components. The rotors and the stator have radially oriented vanes. In this manner, the stator, together with the rotors, forms working chambers that can be filled with a hydraulic medium under pressure, so that a relative rotation occurs between the appertaining rotor and the stator around the rotational axis of the camshaft phaser. A partition wall that is arranged between the rotors as a component of the stator axially separates the rotors from each other. Each rotor can be connected to a camshaft. In this case, the camshaft is configured as a hollow shaft, whereas the other camshaft is made of solid material. Both camshafts are arranged concentrically with respect to each other. The cams that are associated with the camshafts are connected to their camshaft in such a way that a relative circumferential rotation of the cams or of the associated camshafts can occur relative to each other, so that the timing of the inlet and outlet valves associated with the cams can be adjusted continuously and variably.

The vanes of the rotors and the vanes of the stator have a certain surface which is exposed to pressure when the working chambers are filled with a hydraulic medium, and thus it is exposed to a force in the circumferential direction that gives rise to the relative rotation. The response behavior of such a hydraulic camshaft phaser is determined by this surface and by the pressure of the hydraulic medium that is generated by a pressure-medium pump.

SUMMARY OF THE INVENTION

It is an objective of the invention to provide a camshaft phaser that has an especially compact design.

The present invention provides that the drive element and the driven elements all fundamentally have two end faces that are arranged virtually perpendicular to the rotational axis of the camshaft phaser. Between the end faces, the element is delimited by a lateral surface, thus forming a cylindrical hub. Extending from this lateral surface in the radial direction are several vanes which, in order to form the working chambers, are arranged in such a way that, when the working chambers are pressurized with the hydraulic medium, the circumferential distance between a pair of vanes changes, allowing a relative movement between the drive element and the driven elements. The arrangement of the vanes on the lateral surface is similar to the shape of a star or flower. The interstices between the vanes are limited in the axial direction by disks that are directly or indirectly non-rotatably joined to the associated driven element or to the drive element.

According to the invention, the vanes of the first driven element project axially beyond a surface of the first driven element that is offset parallel to the end face and they cover a lateral surface of the second driven element or else, since the design is analogous to the first driven element, they cover its hub. The vanes of the second driven element extend in the axial direction slightly beyond its end-face delimitations. Therefore, the vanes of the drive element extend over the lateral surface of both driven elements, whereby the driven elements are arranged coaxially one after the other along the rotational axis. Together with the vanes of the first driven element, the vanes of the drive element form a vane pair which, when pressurized with the hydraulic medium, rotates the first driven element with the drive element. Together with the vanes of the drive element, the vanes of the second driven element form another vane pair which, when pressurized with the hydraulic medium, rotates the second driven element with the drive element. Since the vane pairs are independent, the working chambers can be advantageously regulated and filled with hydraulic medium independently, and they execute a rotational movement of each driven element relative to the drive element independently of each other. An advantageous aspect is the overlapping, nesting arrangement of the vanes on the driven element and the reduction of the axial installation space.

In another embodiment of the invention, the vanes of the second driven element extend axially over the lateral surface of the first driven element in the same manner as the vanes of the first driven element extend over the lateral surface of the second driven element. Here, the drive element axially covers both driven elements. This translates into an additional reduction of the installation space in the axial direction as a result of the overlapping of both driven elements.

Moreover, with the same installation space, a larger pressure-active surface area of the vanes can advantageously be made available, which reduces the output requirements made of the pump for conveying the hydraulic medium that is used to hydraulically pressurize the working chamber. Thanks to the larger active surface area of the vanes, the pump can be dimensioned smaller, which is why it lends itself for use in smaller internal combustion engines.

In one embodiment of the invention, the first driven element has a contact surface that is located between its end faces and that is offset parallel to the first driven element. The offset contact surface is in direct contact with a surface of the second driven element that adjoins it axially. Thus, both driven elements are arranged axially nested. Advantageously, this contact surface is situated in the vicinity of the hub of the driven elements. The parallel offset contact surface yields another lateral surface that is configured so as to run around almost completely in the circumferential direction. Alternatively, the contact surface can be arranged outside of the end faces, thereby forming a pin-like projection by means of which the two driven elements can be arranged so as to be centered and coaxial with respect to each other.

In one optional embodiment, the contact surface that is touched by both driven elements can be provided with sealing means. Consequently, no hydraulic medium can be transferred via this contact surface.

The contact surface can be configured as a circular ring-shaped flat surface. The term circular ring-shaped can also be understood as circular by way of exception. As an alternative, the contact surface can also be configured so as not to be flat or not perpendicular to the rotational axis.

In an especially preferred embodiment, the driven elements are each tensioned with the drive element by a spring means, at least in a given angular area. This has the advantage that the driven element in question is moved into a resting position or into a locking position towards the drive element when there is no pressure from the hydraulic medium. Primarily torsion springs or coiled springs are an option as the spring means.

In one embodiment of the invention, the camshaft phaser has a locking mechanism that couples a drive element to the driven element when it is locked, thus non-rotatably joining them to each other, while when it is unlocked, it uncouples the drive element from the driven elements, thus allowing a rotational movement of the driven element in question relative to the drive element. Such locking mechanisms secure the position of the driven element relative to the drive element when the working chambers are not pressurized.

In an especially preferred embodiment, one of the driven elements has the locking mechanism. Here, the locking mechanism can be located in a vane of the driven element or in the hub of the driven element. The driven element has a connecting link which can engage with a slidable locking mechanism in order to block a relative rotational movement. The arrangement of the locking mechanism in the area of the hub is advantageous because, with this configuration, the vanes of the driven element are configured to be thin in their circumferential extension, as a result of which large angles of rotation can be realized with one relative rotation.

In another embodiment of the invention, the vanes are equipped with a sealing means that is springy in the radial direction. These sealing means seal off the working chambers from each other, thus reducing internal leakage and increasing the efficiency of the camshaft phaser. In this context, it is advantageous that the springiness of the sealing means compensates for tolerances and play in the radial direction.

In an advantageous embodiment of the arrangement of the driven elements with the drive element according to the invention, each of the driven elements can be connected to associated camshafts. The camshafts are arranged concentrically, whereby the outer camshaft is configured as a hollow shaft while the inner camshaft is configured as a hollow shaft or else it is made of solid material. The drive element is operationally connected to the crankshaft, for example, by means of a belt drive. Each camshaft has a group of cams for a certain function, for instance, one camshaft has the cams for the outlet valves, while the other camshaft has cams for the inlet valves. The cams for the inner camshaft are mounted on the outer hollow shaft, but are connected non-rotatably to the inner camshaft by means of a pin connection. The pin connection projects through the outer hollow shaft via slots. The mechanical connections of the driven elements are implemented positively, non-positively or adhesively.

In an especially preferred embodiment of the invention, the rotational movement of the driven elements relative to each other causes the associated camshafts to be rotated relative to each other, resulting in a valve-stroke overlap, and it also causes the driven elements to be rotated relative to the drive element, which changes the timing of the crankshaft.

The advantageous arrangement can be implemented in very tight installation spaces and the hydraulic medium present in the internal combustion engine is ideally employed to adjust the camshaft phaser. This gives rise to a camshaft phaser that can be connected to a camshaft phaser system, as a result of which pairs of cams can be rotated relative to each other in order to change the valve-stroke overlap and, in addition, the camshafts with the drive element, which is operationally connected to the crankshaft, can be adjusted for purposes of adjusting the timing vis-à-vis the piston position.

BRIEF DESCRIPTION OF THE DRAWINGS

Embodiments of the invention are depicted in the figures. The following is shown.

DETAILED DESCRIPTION

Figure 1:
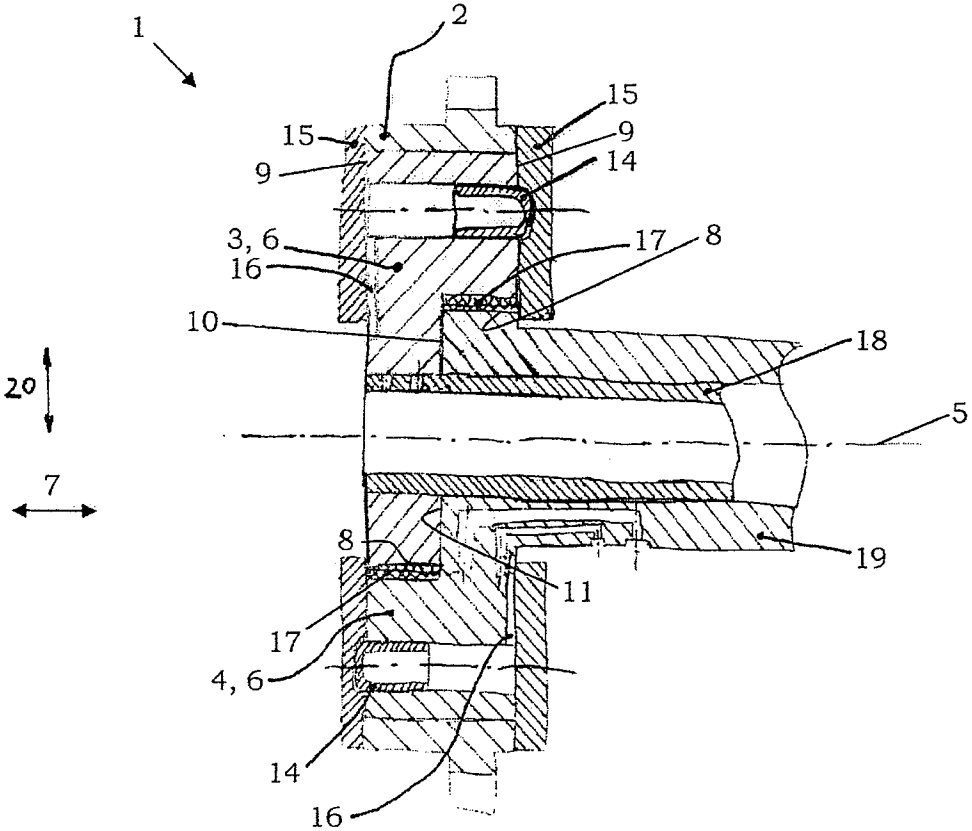
FIG. 1 a camshaft phaser according to the invention, in a longitudinal section along the rotational axis of the camshaft phaser, and FIG. 2 a camshaft phaser according to the invention, in a cross-sectional view perpendicular to the rotational axis of the camshaft phaser.

FIG. 1 shows a camshaft phaser 1 according to the invention, in a longitudinal section along the rotational axis 5 of the camshaft phaser 1. The camshaft phaser 1 has a drive element 2, two driven elements 3 and 4, two disks 15, several sealing elements 17 as well as the locking mechanisms 14 that are each associated with the driven elements. On its outer lateral surface, the drive element 2 has a chain rim that holds a belt and chain drive (not shown here). The drive element 2 also has several vanes 6 that extend in the radial direction 20. The driven elements 3 and 4 are arranged concentrically to the drive element 2. The driven elements 3, 4 also have several vanes 6 extending in the radial direction. Together with the drive element 2, the vanes 6 of the driven elements 3 and 4 form several working chambers A, B, C, D. At least one vane 6 of the driven element 3 has a locking mechanism 14. The outer dimensions of the driven element 3 are delimited by the end faces 9. Between these end faces 9, the driven element 3 has a parallel offset contact surface 10. The driven element 3 is non-rotatably fastened with its hub to an inner camshaft 18. The driven element 4 likewise has several radially oriented vanes 6, whereby at least one vane 6 has a locking mechanism 14. The locking mechanisms 14 are arranged parallel to the rotational axis 15 and are formed with a coupling piston and a spring element (not shown here). Sealing means 17 are arranged between the driven elements 3 and 4. These sealing means 17 serve to separate the working chambers (not shown here) from each other so as to be virtually oil-tight. Between the end faces of the driven element 4 there is likewise a parallel offset surface 11 that is in direct contact with the contact surface 10 of the driven element 3. The driven element 4 is non-rotatably joined to the outer camshaft 19. The camshaft phaser 1 is flanked axially by two disks 15. These disks 15 have connecting-link receptacles into which the coupling pistons of the locking mechanism can latch, thus establishing a non-rotatable connection between the driven element 3 or 4 and the drive element 2. FIG. 1 shows the locked position of the coupling piston of the locking mechanism 14. On the end face of the driven elements 3 and 4 facing away from the camshaft, said driven elements 3 and 4 have venting channels 16 by means of which foreign matter coming from the locking mechanisms 14, especially from the spring chamber where a locking spring is arranged, can be released into the environment and discharged from the camshaft phaser. These venting channels 16 are formed by the axial, flat arrangement of the associated driven element 3 or 4 together with the disk 15 facing away from the camshaft, and they extend in the radial direction.

The vanes 6 of the driven element 3 extend in the axial direction 7 over a lateral surface 8 of the driven element 4. By the same token, the vanes 6 of the driven element 4 extend over a lateral surface 8 of the driven element 3. In this area of overlap, the sealing means 17 are arranged in the radial gap between the vane 6 and the lateral surface 8.

Figure 2:
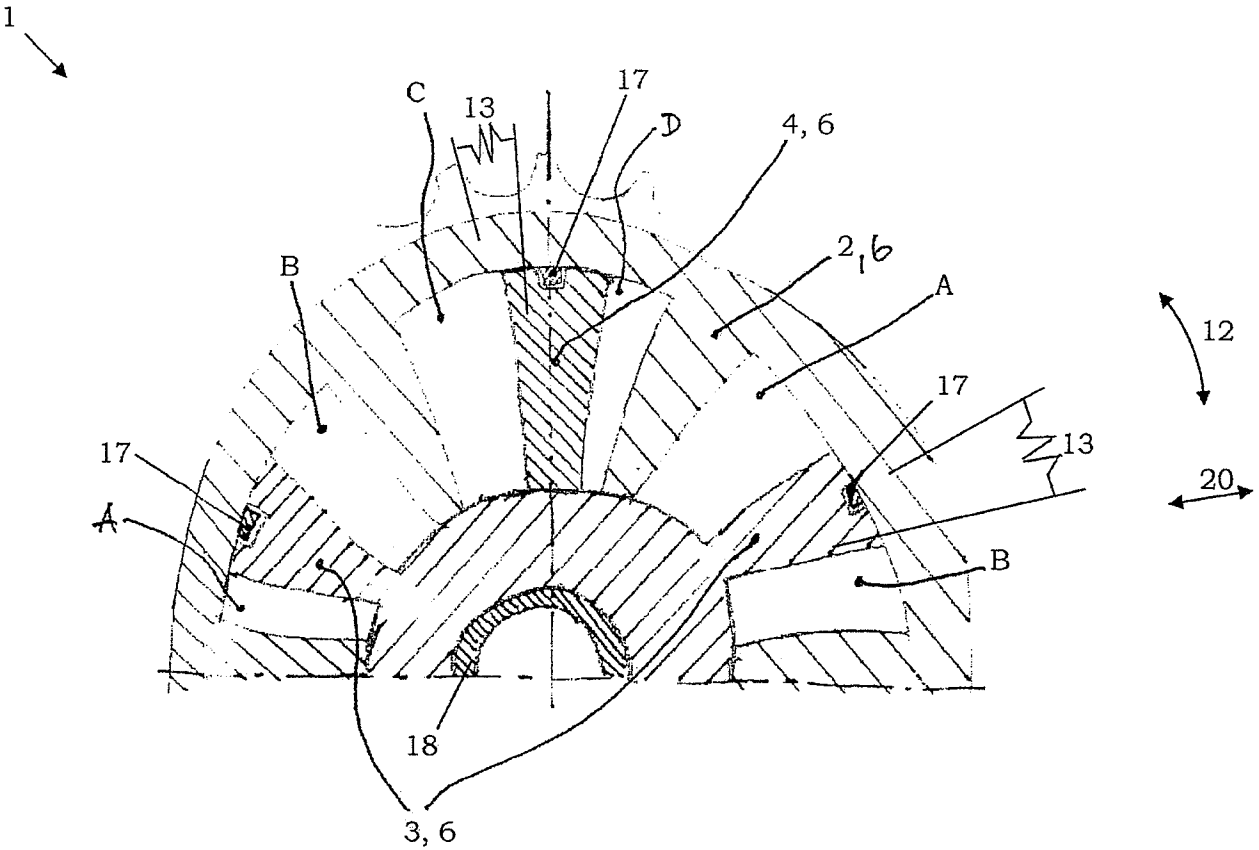

FIG. 2 shows a camshaft phaser 1 according to the invention, in a cross-sectional view perpendicular to the rotational axis 5 of the camshaft phaser 1. This depiction shows the working chambers A, B, C, D that are formed by the driven elements 3 and 4 together with the drive element 2. Together with a vane pair of the drive element 2, each vane 6 of a driven element 3 or 4 forms two working chambers. Therefore, together with the vanes 6 of the drive element 2, the vane 6 of the driven element 3 defines the working chambers A and B. In contrast, in a similar manner, together with the drive element 2, the driven element 4 defines the working chambers C and D. The radial, outer ends of the vanes 6 of the driven elements 3, 4 have sealing means 17 that separate the working chambers so as to be oil-tight. Moreover, the camshaft phaser 1 has at least one spring element 13 between a driven element 3 or 4 and the drive element 2 in the circumferential direction 12. Here, the driven elements 3, 4 are each tensioned with the drive element 2 by means of a spring element 13.

Therefore, when the working chamber A or B is filled with hydraulic medium, the driven element 3 can be rotated relative to the drive element 2. Filling the working chambers C and D with hydraulic medium results in a relative rotation between the driven element 4 and the drive element 2.

LIST OF REFERENCE NUMERALS

1 camshaft phaser
2 drive element
3 first driven element
4 second driven element
5 rotational axis
6 vanes
7 axial direction
8 lateral surface
9 end face
10 contact surface
11 surface
12 circumferential direction
13 spring element
14 locking mechanism
15 disk
16 venting channel
17 sealing means
18 first camshaft
19 second camshaft
20 radial direction
A working chamber
B working chamber
C working chamber
D working chamber

The invention claimed is:

1. A camshaft phaser comprising:
a drive element;
a first driven element; and
a second driven element,
each of the drive and first and second driven elements being arranged coaxially to a rotational axis of the camshaft phaser, each of the first and second driven elements and the drive element having several radially oriented vanes forming working chambers, each working chamber being defined by a vane pair defined by a vane of the drive element and a vane of one of the first and second driven elements, the working chambers pressurizable by a hydraulic medium so that a relative rotation is made possible between the drive element and the associated first or second driven element, the first and second driven elements being arranged axially one after the other in such a way that a vane of the first driven element extends in the axial direction along a lateral surface of the second driven element, and a vane of the second driven element extends in an axial direction along a lateral surface of the first driven element.

2. The camshaft phaser as recited in claim 1 wherein the first driven element has two end faces and a parallel offset contact surface between the two end faces, the contact surface being in direct contact with an axially adjoining surface of the second driven element.

3. The camshaft phaser as recited in claim 1 wherein the vanes have a seal configured to be springy in the radial direction.

4. The camshaft phaser as recited in claim 1 wherein one of the first and second driven elements is pre-tensioned with the drive element via a spring element in the circumferential direction.

5. The camshaft phaser as recited in claim 1 further comprising a lock either preventing or allowing a movement of the drive element relative to one of the first and second driven elements.

6. The camshaft phaser as recited in claim 5 wherein one of the first and second driven elements has the lock.

7. The camshaft phaser as recited in claim 6 wherein the lock has a venting channel to discharge foreign matter from the camshaft phaser, the venting channel being formed by the individual first and second driven elements.

8. The camshaft phaser as recited in claim 7 wherein the venting channel is formed by the associated first or second driven element together with a disk, the venting channel extending in the radial direction.

9. The camshaft phaser as recited in claim 1 wherein the first driven element is joinable to a first camshaft, while the second driven element is joinable to a second camshaft.

10. A camshaft system comprising the camshaft phaser as recited in claim 9, the first camshaft and the second camshaft, the first driven element being joined to the first camshaft, while the second driven element is joined to the second camshaft, and when the working chambers are pressurized by a hydraulic medium, a rotation of both the first and second driven elements relative to each other occurs, and thus also of the first and second camshafts relative to each other, as well as another rotation of the first and second driven elements relative to the drive element.

11. The camshaft phaser as recited in claim 1 further comprising a seal between the vane of the first driven element and the the lateral surface of the second driven element, and a further seal between the vane of the second driven element and the lateral surface of the first driven element.

12. A camshaft phaser comprising:
a drive element;
a first driven element; and
a second driven element,
each of the drive and first and second driven elements being arranged coaxially to a rotational axis of the camshaft phaser, the first and second driven elements and the drive element having several radially oriented vanes forming working chambers, each working chamber being defined by a vane pair defined by a vane of the drive element and a vane of one of the first and second driven elements, the working chambers pressurizable by a hydraulic medium so that a relative rotation is made possible between the drive element and the associated first or second driven element, the first and second driven elements being arranged axially one after the other in such a way that a vane of the first driven element extends in the axial direction along a lateral surface of the second driven element, one of the first and second driven elements having a lock either preventing or allowing a movement of the drive element relative to one of the first and second driven elements, wherein the lock has a venting channel to discharge foreign matter from the camshaft phaser, the venting channel being formed by the individual first and second driven elements.

13. The camshaft phaser as recited in claim 12 wherein the venting channel is formed by the associated first or second driven element together with a disk, the venting channel extending in the radial direction.

* * * * *